United States Patent [19]

Kidd

[11] Patent Number: 4,708,069

[45] Date of Patent: Nov. 24, 1987

[54] SOLID FUEL HEATING APPLIANCE

[76] Inventor: Archibald W. Kidd, Seend Close, Seend, Melksham, Wiltshire, England

[21] Appl. No.: 867,629

[22] Filed: May 27, 1986

Related U.S. Application Data

[63] Continuation of Ser. No. 496,209, May 19, 1983, abandoned.

[30] Foreign Application Priority Data

| | | | |
|---|---|---|---|
| May 21, 1982 | [GB] | United Kingdom | 8214876 |
| Jul. 19, 1982 | [GB] | United Kingdom | 8220844 |
| Jan. 28, 1983 | [GB] | United Kingdom | 8302399 |

[51] Int. Cl.[4] ..... F23K 3/14

[52] U.S. Cl. ..... 110/275; 110/288; 126/1 F; 126/4; 126/150

[58] Field of Search ..... 110/287, 289, 275, 288; 126/1 B, 1 F, 4, 5, 6, 7, 10, 20.1, 21 A, 34, 150, 170, 243

[56] References Cited

U.S. PATENT DOCUMENTS

| | | | |
|---|---|---|---|
| 347,463 | 8/1886 | Boyer | 126/5 |
| 468,033 | 2/1892 | Carter | 126/150 |
| 745,573 | 12/1903 | Cox | 110/287 |
| 821,487 | 5/1906 | Hammack | 126/1 B |
| 1,013,330 | 1/1912 | Thomas | 110/287 |
| 1,237,735 | 8/1917 | Wright | 126/6 |
| 1,598,579 | 8/1926 | Van Brunt et al. | 110/287 |
| 1,801,694 | 4/1931 | Sandoe | 110/275 |
| 1,871,653 | 8/1932 | Best | 110/275 |
| 1,956,939 | 5/1934 | Wynn, Jr. | 110/287 |
| 2,033,706 | 3/1936 | Hall | 110/275 |
| 2,039,389 | 5/1936 | Buskard | 126/150 |
| 2,072,874 | 3/1937 | Geiselman | 110/287 |
| 2,080,410 | 5/1937 | Guikshank | 110/275 |
| 2,119,937 | 6/1938 | Banfield | 110/287 |
| 2,141,831 | 12/1938 | Stockstrom et al. | 126/10 |
| 2,160,803 | 5/1939 | Goerg | 110/288 |
| 2,163,291 | 6/1939 | Raddatz | 110/287 |
| 2,224,316 | 12/1940 | Rolfes | 126/1 F |
| 2,258,388 | 10/1941 | Leiby | 110/288 |
| 2,300,486 | 11/1942 | Cargile | 126/10 |
| 2,527,594 | 10/1950 | Suman | 110/275 |
| 2,568,657 | 9/1951 | Pfau | 126/150 |
| 2,908,157 | 10/1959 | Bliss et al. | 126/1 F |
| 4,384,535 | 5/1983 | McKelvie | 126/170 |

FOREIGN PATENT DOCUMENTS

| | | | |
|---|---|---|---|
| 35535 | 1/1926 | Denmark | 126/34 |
| 219009 | 2/1909 | Fed. Rep. of Germany | 110/287 |
| 9213498 | 2/1955 | Fed. Rep. of Germany | 110/275 |
| 753140 | 3/1933 | France | 110/275 |
| 779477 | 9/1934 | France | 110/287 |
| 1176 | 3/1873 | United Kingdom | 126/1 B |
| 2442 | 6/1884 | United Kingdom | 126/1 B |
| 520421 | 4/1940 | United Kingdom | 110/275 |

*Primary Examiner*—Samuel Scott
*Assistant Examiner*—H. A. Odar
*Attorney, Agent, or Firm*—Larson and Taylor

[57] ABSTRACT

A heating appliance which burns solid fuel has a bottom feed to a furnace vessel, conveniently by means of an auger. The furnace vessel is arranged to be driven in rotation which assists keeping a uniformly distributed fire in the furnace vessel, and makes possible the discharge of ash overflowing from the top of the vessel through an airlock system. Preferably, a water jacket surrounds the furnace vessel and a poker is moved in the furnace vessel as it rotates. Combustion air can be blown or sucked in by a fan. The heating appliance can be a domestic cooker, also heating water for central heating.

16 Claims, 6 Drawing Figures

SOLID FUEL HEATING APPLIANCE

This application is a continuation of application Ser. No. 496,209, filed May 19, 1983, now abandoned.

FIELD OF THE INVENTION AND DESCRIPTION OF THE PRIOR ART

This invention relates to a heating appliance which burns carbonaceous solid fuel.

A variety of solid fuel appliances are known for domestic cooking and to a greater or lesser extent for heating the housing as well as cooking. Probably the best known is the "Aga" cooker. However, domestic solid fuel appliances for heating and cooking frequently have the limitation that they require very refined fuel such as anthracite or the partially coked fuel sold in UK under the Registered Trade Mark "phurnacite", and will not operate smokelessly on cheaper and dirtier grades of coal; indeed they may well not operate on such at all. It is also a characteristic of the appliances that the fire needs to be riddled by hand, in some way or other, at regular intervals to prevent the fire going out. They have gravity-fed grates which tend to be self-blocking since ash and clinker work down to the bottom of the grate and stick there. It is not easy to remove all this rubbish while the fire is burning. A further disadvantage of some of these appliances is their very limited output so that they are not adapted to heating the whole house as well as providing a good supply of domestic hot water. In addition, many of these existing appliances are sluggish in their response to a call for a different oven temperature so that, in some cases, a significant change of oven temperature can take at least several hours, which is not very convenient to the housewife. On top of all this is the fact that such appliances typically are not very efficient in that, winter and summer they lose a great deal of heat to their immediate surroundings, which at present day fuel costs, is rather a costly waste, while because of the difficulty and inconvenience of the lighting the fire they are left burning all the time instead of being out at night.

If, therefore, solid fuel domestic cooker-heaters are to become popular, at least some of the above disadvantages and drawbacks must be reduced or overcome.

The provision of a bottom feed to a fire, usually by means of an auger is known. Proposals for this, exemplified for example by U.S. Pat. No. 2,370,246 and U.K. specification No. 553278 generally employ fixed fire enclosures. U.S. Pat. No. 2,370,246 shows a rotary member surrounding the fixed fire enclosure which is rotated for the purpose of carrying away ash spilling over from the fire enclosure.

The rather elderly U.K. specification No. 245,589 includes two FIGS. (6 and 7) which show a fire enclosure capable of rotation and into which the fuel is fed slightly above the bottom of the fire enclosure. The fuel is fed by a pusher which is apparently operated manually. No means are provided for rotating the fire enclosure and presumably this would have to be done by means of a hand tool, such as a poker, inserted between the vertical bars of the enclosure. The apparatus appears to be in the nature of a brazier where the fire is visible, and indeed a reflector is provided for reflecting the heat out in a particular direction.

SUMMARY OF THE INVENTION

In a first aspect, this invention provides a domestic or small industrial heating appliance fired by solid fuel having a rotary furnace vessel to contain a fire of such fuel, means to drive the vessel in rotation around a generally upright axis during at least some of the time when it is in use, and fuel supply means arranged to deliver solid fuel to the bottom of the said furnace vessel.

Rotation of the furnace vessel (especially when it is simultaneous with the supply of fuel) helps to create a uniformly distributed fire with large and small fuel particles distributed around the fire as viewed in plan. An auger tends to degrade (i.e. crush) solid fuel to some extent and without rotation large lumps would tend to go to one side of the fire and small particles to another. Of course, the centre of the fire will be somewhat different from its edges, but there is greater uniformity between different edge areas around the centre. The enhanced uniformity in fuel distribution around the fire also leads to enhanced uniformity around the fire of the rates of air flow, combustion and ash formation. All of this facilitates smooth operation which can be made largely automatic.

Rotation of the furnace vessel also creates the possibility of carrying discharging ash around to a desired discharge point, which may be through an airlock system. Rotation can be of some help in preventing formation of coke trees, although it is preferred to provide a poker (as mentioned below) in addition.

The following features are preferably also employed, but separately constitute invention:

(1) ignition by gas jets directed at air inlets to the fire enclosure, (2) a water jacket around a rotating fire enclosure, (3) a toothed wheel meshing with air inlet slots to the fire enclosure and thus serving to poke these out as the fire enclosure rotates, (4) means sensing when the bottom-fed rotary fire enclosure is fully fuelled, and arranged to stop the fuel feed, (5) a poker moving up and down in the fire enclosure to prevent caking of coal and formation of coke trees.

(6) a solid-fuel domestic heating appliance having an oven, wherein the oven is heated by combustion gases from the fire rather than relying upon conduction of heat through metal structure, (7) a bearing to reduce friction while giving support around the upper part of a rotary fire enclosure, (8) a layout in which fuel is fed laterally to the bottom of a fire through which combustion air is forced or induced, the lower part of the fire enclosure being located within a chamber through which the combustion air passes on its way to the fire, while ash or clinker is allowed to fall from the top of the fire, through an airlock system into and through the said chamber, (9) forced delivery of air so as to pass into the flue without passing through the fire, at least at the time of lighting the fire, so as to induce a suction within the appliance.

Although the present invention is conceived primarily for solid fuel domestic appliances incorporating at least one oven and means for heating water, it is believed that at least some of the inventions could also be employed in small industrial plant, notably for heating an oven such as a drying oven or an annealing oven, an autoclave or a boiler.

DESCRIPTION OF PREFERRED EMBODIMENTS

Figure 1:
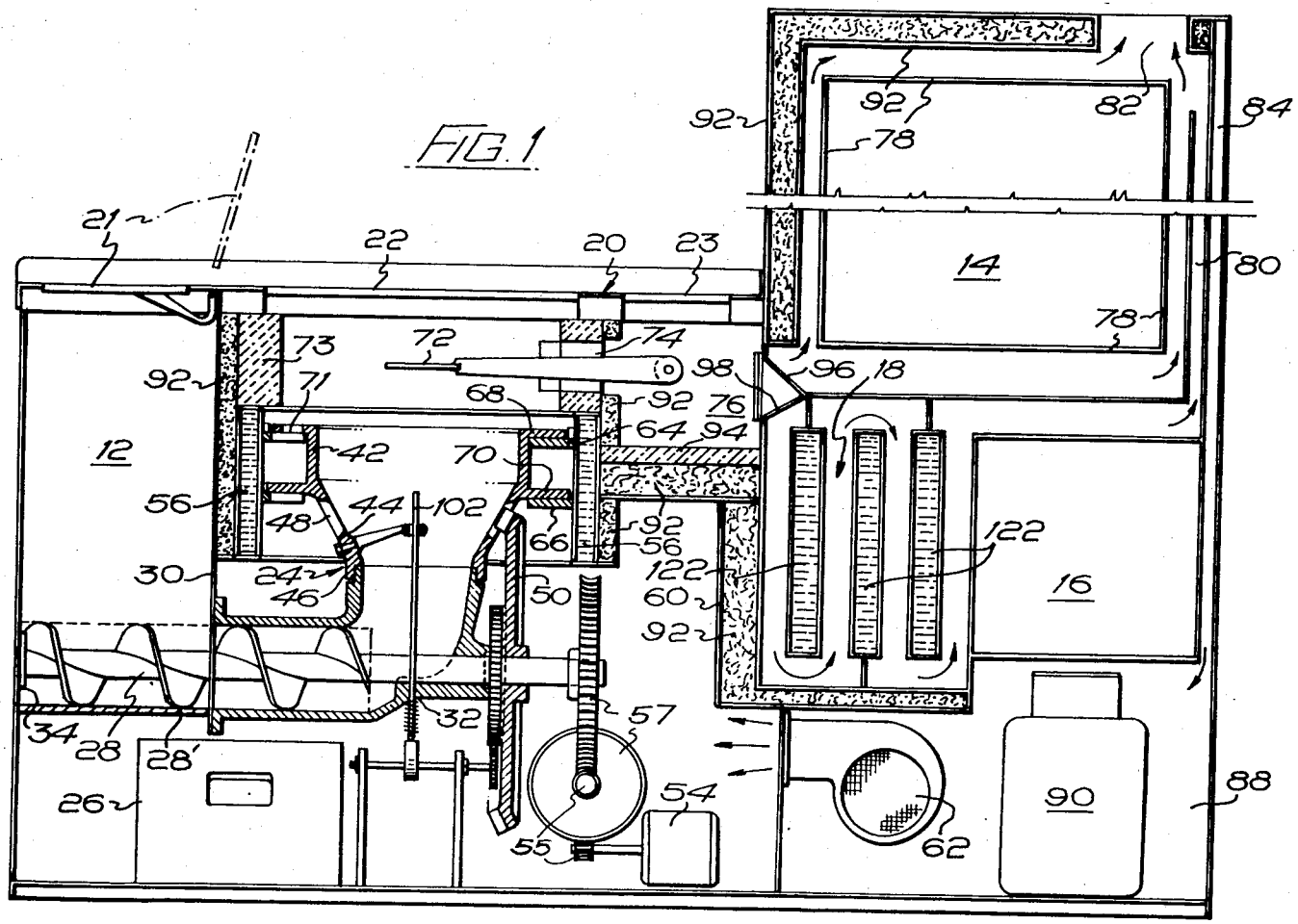
FIG. 1 is a diagrammatic side view largely in section.

The heating and cooking appliance shown in the drawings has a coal hopper 12 at the left hand end, two ovens 14,16 at the right hand end and the fire inbetween. The main oven 14 is at a high level for obvious reasons of convenience to the user. It should be appreciated of course, that only a single oven might be provided. In the appliance shown the main hot water boiler 18 is also at the right hand end with the ovens but this could also be placed in other positions.

As a guide, the appliance shown could have typical dimensions of 24 inches (600 mm) front to back and 5 foot 9 inches (1700 mm) horizontal length. Over the coal hopper and furnace section there is a worktop 20 incorporating hot-plates 22,23. This worktop is at a height of about 3 feet (900 mm) from the floor.

The furnace is generally indicated by numeral 24. An ash collecting receptacle is provided in the form of a drawer 26, somewhat resembling a metal filling cabinet drawer. This is placed at low level and extends partly under the coal hopper 12 and partly under the furnace 24. With good fuel such as anthracite this ash drawer 26 should not need emptying oftener than once every 4 to 7 days, while with cheaper and dirtier coal the period might be reduced to two days.

Dry coal of say ¾" to 3/16" size may be used, although it is quite possible that a proportion of dust or fines will be acceptable. This is manually filled, preferably using a specially shaped scoop or hod, into the coal hopper 12 through an opening into the worktop 20 which is normally closed by a flush-fitting cover plate 21 which swings open to the position shown in phantom. The bottom of the hopper 12 is V shaped and inclines from front and back to the centre at such an angle that coal will freely run. Along the bottom of the valley so formed is an auger trough 28' in which an auger 28 when revolving, conveys the coal to the furnace section of the appliance.

Once through the partition 30 forming the wall of the hopper the entrained coal finds itself in a tubular casting 32 which then turns upwards into a vertical direction. The stream of fuel therefore is caused to flow vertically upwards into the bottom of the furnace 24 which is thus bottom-stoked. As the tube 32 turns upwards, it increases in cross-sectional area.

By stoking from the bottom, it is ensured that smoke from the coal (which may well be a non-smokeless coal) will have to pass upwards through the hot area of the furnace and will thus be consumed, hence providing smokeless combustion even with cheap coal. One end of the auger is carried in a bearing 34 in the outside wall of the coal hopper 12. The other, inward end, of the auger shaft may be carried by a bearing at 36 in the outside wall of the coal feed-tube 32. An alternative (not shown) would be for the auger shaft to pass through a clearance hole in the feed tube and be carried by a bearing in a gearbox from which a low speed drive is given to the auger shaft. It will be understood that the auger will work intermittently, working only when the furnace needs more coal. The auger revolves at a very low speed, such as one revolution in two minutes or even slower.

The furnace 24 is a round vessel having an upper cylindrical section 42, a frusto-conical middle section 44 and a bottom section 46 which is again approximately cylindrical. The top and bottom of the vessel are open. It is preferably made as a casting but it could alternatively be of welded construction. The upper part 42 of this vessel may have a diameter of approximately 12 inches (300 mm). It will be understood that a greater or lesser diameter may be adopted according to the desired rated heat output of the appliance.

The lower part 46 of the vessel 24 is loosely spigoted on the upturned delivery end of the coal tube 32 so that the vessel 24 is able to revolve on a vertical axis.

A ring of slots 48 is provided in the frusto-conical section 44 of the vessel. These slots are arranged to mesh with the teeth of a bevel gear 50 (shown in section) carried on the end portion 52 of the auger shaft.

The auger shaft is driven by an electric motor 54 through reduction gearing which includes worm gears 55 meshing with gears 57 by means of which a very substantial speed reduction is obtained. By means of this arrangement the furnace vessel 24 is made to revolve each time the auger 28 is driven to feed more coal to the furnace. The speed of rotation of the furnace is very slow, typically one revolution every two to four minutes.

As has been mentioned, the air inlet slots 48 have a dual function in that they are also used for conveying drive to the furnace. The teeth on the bevel gear 50 are made long enough to project just through the slots 48 or almost through these slots so that as the furnace revolves the slots are poked out by the teeth of the gear wheel 50. In this way a free path is maintained for the supply for combustion air to the fire.

Figure 2:
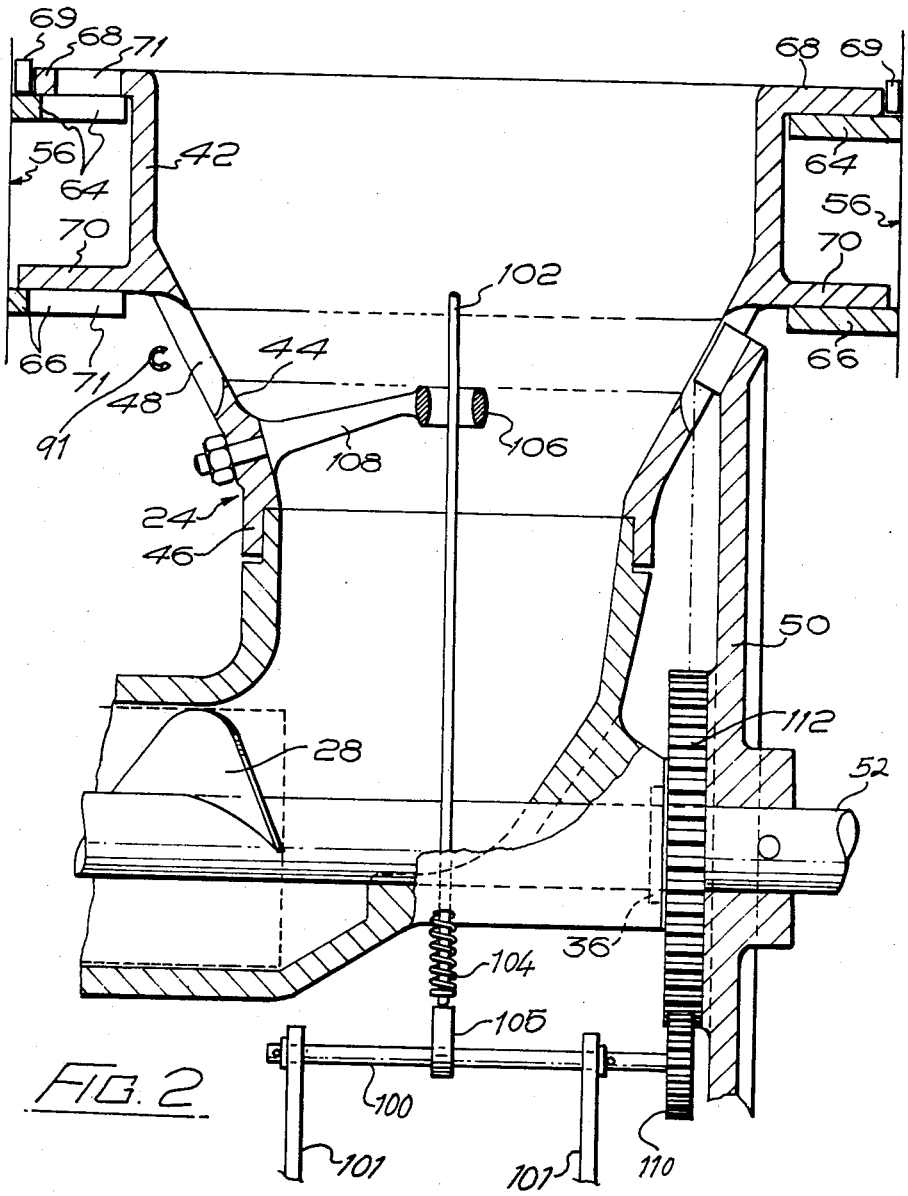
FIG. 2 is a similar diagrammatic view showing part of the furnace to a larger scale.

As is best seen from FIG. 2, a poking arrangement is provided to agitate the central part of the material in the furnace while further coal is being fed in. A problem which has been encountered with bottom fed furnaces is that the fuel in the middle of the furnace is only partly burned and is converted into coke. This then forms a solid body progressively rising up through the central part of the fire as what is termed a "coke tree". The problem would occur particularly with caking coals which fuse into a plastic mass when heated and prevent the combustion air from reaching the central part of the furnace.

As shown by FIG. 2 a shaft 100 is journalled in brackets 101 generally beneath the delivery end of the coal tube 32. A rod, constituting a poker 102 is a sliding fit in a hole in the coal tube 32, and projects up into the vessel 24 in front of the auger shaft into the vessel 24.

The lower end of the poker 102 is urged by a spring 104 down onto a cam 105 on the shaft 100. The upper part of the poker 102 is loosely supported in a collar 106 on the end of the arm 108 fixed to the vessel 24. The upper end of the poker 102 is shown as being about half-way up the vertical height of the furnace vessel 24. However, a more or less high position may be found acceptable. The shaft 100 is driven by a gear 110 meshing with a gear 112 on the auger shaft. The spur gear 112 may be cast intergral with the larger bevel gear 50, as shown. Because of the low speed of revolution of these gear wheels, simple cast teeth may be adequate.

When the auger shaft rotates, delivering fuel to the bottom of the furnace vessel 24, the shaft 100 and cam 105 are also driven, causing the poker 102 to move up and down in the collar 106.

The movement of the poker 102 serves to break up the underside of the plastic mass which tends to form from caking coal. The poke breaks up this mass as it is forming and while it is still fairly soft, before it hardens into material more in the nature of coke. Breaking up the plastic mass in this way enables combustion to become established and it is therefore unlikely that the fuel will again form into a plastic mass higher. up in the fire bed. Problems from coke trees are therefore prevented by preventing the formation of the coke like material. However, if any coke tree did form this would also be subjected to the agitation of the poker 102, and so could well to broken up or displaced into a position nearer the periphery of the fire where it would be burned.

The furnace will get very hot and it is therefore surrounded by a circular water jacket 56 which is connected into the water heating system to be described later. This water jacket provides a heat sink to ensure that the furnace chamber, that is to say the part of the unit housing the furnace, does not become overheated.

The furnace as illustrated is operated with forced draught, although induced draught may be used as an alternative. For this purpose it is contained within an enclosed space defined by the water jacket 56 and various walls e.g. 60, of the unit. Air is blown into this space when required, by a fan 62 which provides the forced draught. The fan 62 has a flat pressure-flow characteristic to aid combustion control. The forced draught of air enters the fire through the slots 48 and is prevented from escaping up the outside of the furnace vessel 24 by a rotating airlock system around the upper part 42 of this vessel even though this air lock system allows ash and clinker to drop into the ash drawer 26 as is explained subsequently. This airlock system consists of four co-operating annuli. Two of these annuli are stationary annular flanges or ledges 64,66 extending radially inwardly from the inside of the water jacket 56 for a radial depth of say 3 inches (75 mm) and spaced apart vertically by about the same amount. The other annuli are two annular flanges 68,70 which project radially outwardly from the upper part 42 of the furnace and rest lightly on the upper surface of the flanges 64,66 respectively.

The furnace 24 not only rotates on the loose spigot at its base, as already mentioned, but is also guided by the edge of one of its two flanges 68,70. As shown in the drawing the edge of the top flange 68 bears on rollers 69 interposed between it and the inside of the water jacket 56, as best seen on FIG. 2. Suitably, this top flange is also very approximately 3 inches (75 mm) in radial dimension, as is the flange 70 below. It is feasible that the roller bearing could be provided around the edge of the lower flange 70 rather than the upper flange 68. This could be advantageous, because then the top part of the furnace vessel 24, above the flange 70 could be a separate part spigotted on the rest, with some vertical play to take up the effect of expansion and keep both moving flanges 68,70 closely adjacent to the associated stationary flanges 64,66.

Figure 5:
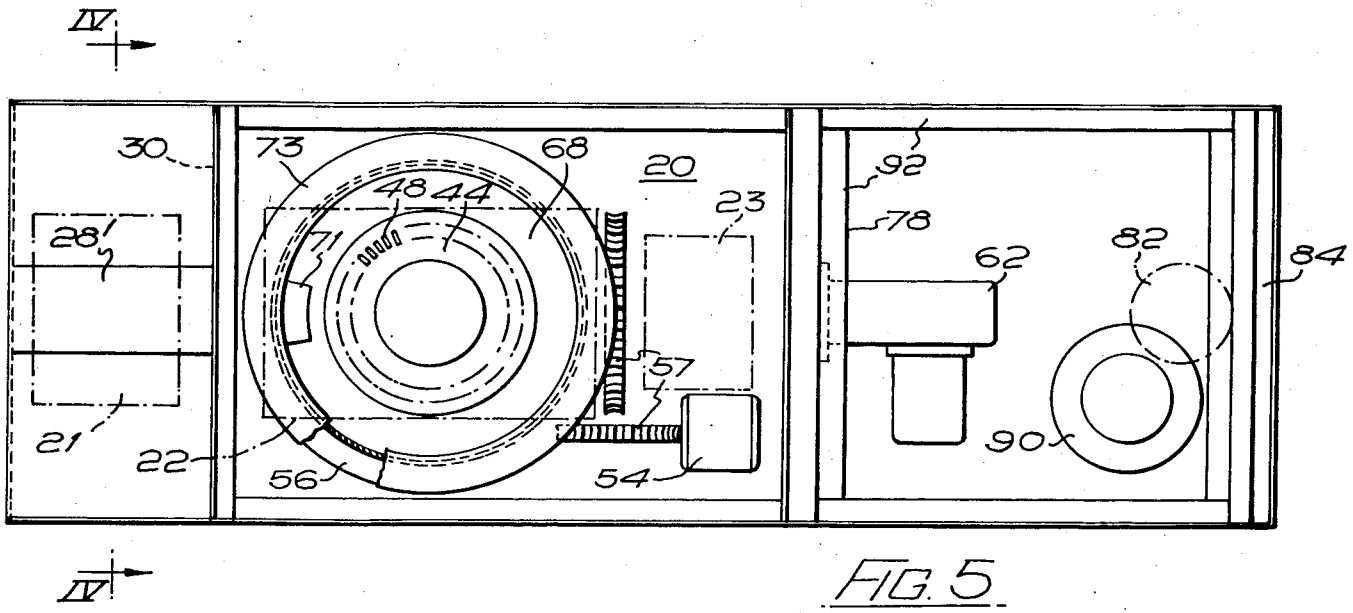
FIG. 5 is a diagrammatic plan view of the appliance onto and through the top, showing the positions of various parts.

The ring of rollers is not shown in detail in FIG. 5. However, it may consist of rollers spaced apart by inserts between successive rollers 69. These would not revolve, but would slide on the stationary flange as the rollers 69 turned. Such inserts could consist of small iron blocks.

Figure 3:
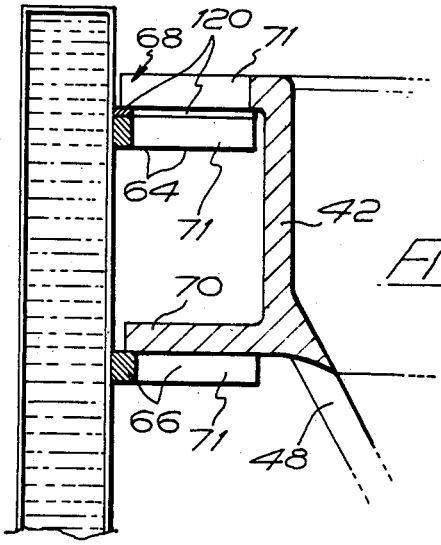
FIG. 3 is a detail showing a modification.
Figure 4:
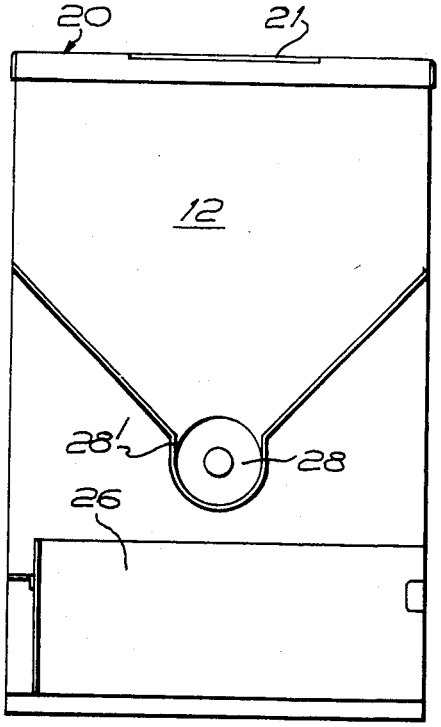
FIG. 4 is a cross section on the line IV—IV of FIG. 5 showing the furnace and the auger duct.

As shown by FIG. 3, another possibility for a simple bearing at the top flange 68 (or the lower flange 70) is to provide a plate of hardened metal 120 as a top surface to flange 70 so that the surfaces in contact are not both of soft iron. This expedient could be employed in addition to the provision of the rollers 69 or even without these rollers (as shown) the edge of the top flange 68 then being allowed to rub lightly against the inside of the water jacket 56.

The flanges 68,70 projecting out from the upper part of the furnace vessel and the flanges 64,66 projecting inwardly from the water jacket each contain slots 71 extending over a large part of their radial depth, and having a circumferential extent of about 4 inches (100 mm). The purpose of these slots is to provide an air lock system which allows ash and clinker, which are carried up through the fire to fall from its top, to drop down past the flanges into the ash drawer 26. The slots in the upper pair of flanges 64,68 are arranged to be closed when the slots in the lower pair 66,70 are open, and vice versa, so that an air lock or seal is maintained. At not time is there a through path for the combustion air which necessarily therefore has to enter the furnace through the slots 48. It will be understood that the water jacket 56 is surrounded by a base plate or make-up baffle so that the forced draught cannot escape past the outside of the water-jacket. It is not essential that the annuli 64–70 are horizontal as shown. They could be at a variety of angles to the horizontal.

As shown in FIG. 2 the slot 71 in the top flange 68 does not extend to the periphery and this is obviously necessary for any flange which bears against rollers 69, in order to keep these in place.

The other slots 71, and all of them in FIG. 3, are shown extending to the free edge of the respective flanges. These need not be so. In each case the slot 71 could stop short of the free edge, as does the top slot in FIG. 2, so as to give a continuous circular free edge to the flange.

When the furnace is filled with coal the top of the pile will press against a pivoted lever 72 extending into the space above the furnace 24. This lever 72 constitutes sensing means to detect the fully fuelled condition. When it is raised by the pressure of the fuel on its underside a switch is actuated which stops the drive motor 54 for the auger-furnace system. If desired a time delay may be incorporated in the motor circuit so that once stopped it cannot re-start for say five minutes, thus preventing hunting the unnecessary "inching" of the drive system.

The ash and any clinker forming in the furnace will gradually be carried up to the top of the fire, in contradistinction to what happens in an ordinary fire grate, and because of the rotation of the furnace, will eventually be scraped by the lever 72 and also being assisted by gravity, will run down the top slopes of the fire and finish up on top of the furnace's top peripheral flange 68. Since this flange rotates, the rubbish will eventually come up against a fixed stop or flap (not shown) projecting radially inwards from the water jacket 56. At this stage it will pile up and await the slot in the flange 68 coming round, through which it will drop. The stop or flap on the water jacket 56 is so positioned in plan view that the slot in the top fixed flange 64 will be in the right spot to allow the rubbish to drop right through on to the top of the lower rotating flange 70. Here the same thing happens; i.e. a stop or flap will hold the moving ash and clinker until the slots in the annular flanges 66,70 coincide, when it will be able to drop right down into the ash tray 26. Should an odd piece of clinker be too large to drop through the slots the drive to the furnace should be powerful enough to exert a shearing and grinding action on it until it does drop.

The rubbish can only drop down at the position of the slot in the lower fixed flange 66. Hence, especially seeing there is an unusually large amount of height available, it can readily be arranged that it drops from there onto the top of the coal tube casting 32 at a point adjacent to the coal hopper partition 30. Alternatively or additionally sloping plates may be arranged to intercept and further spread the ash as it falls. In this way the falling shower will be split and will thus spread itself more evenly along the ash drawer 26 than if it simply fell straight down in which case it would build up into a single conical mound.

The ash drawer 26 which is tight-fitting at its outer end may be provided with a simple light metal cover to prevent dust blowing about while being carried away for emptying.

The parts described so far provide a self-feeding, self-cleaning, smokeless fire giving a source of very hot gases in the space above the furnace. Above this space will be the main cooking hotplate 22, which will be exposed on its underside not only to the said hot gases but also to any radiant heat emanating from the top of the fire. The hot plate will of course have a removable insulating cover on its top side.

Circularly enclosing the hot gas space referred to is a firebrick wall 73. This may be in two sections for ease of installation through the hole which accommodates the hot plate 22. Likewise the furnace 24 and fuel coal tube 32 may be inserted or extracted through the hot plate hole. In this firebrick wall is an opening 74 say about 9" by 3" for example, through which the hot gases can travel sideways towards the oven end of the appliance and into a fairly large insulated chamber 76 with a firebrick base 94. This second hot gas space is for several purposes. Firstly to allow the gases to slow down and thus deposit any dust or fly ash into a place from which it may easily be removed; secondly to allow the hot gases to heat a second hot plate 23 for simmering, and thirdly to provide a chamber to contain the regulating valves, grilles and/ or shutters which regulate and control the heat to the main oven 14 and to the hot water boiler 18 respectively, said chamber 76 being easy of access for inspection purposes.

From this plenum chamber 76 the largely dustfree hot gases may pass through one or both of two regulators which provide the gas exits from the chamber. These are thermostatically controlled flaps or grilles, one 96 of which opens or closes in response to the oven thermostat and the other 98 in response to the hot water thermostat. For such periods as both thermostats require their associated valve to be closed there is a by-pass which will allow sufficient gas to flow to keep the fire alive until a demand is made upon it. This by-pass small flow of hot gas is allowed to circulate round the hot water boiler circuit and so to the chimney but in case of the hot water rising to an undesirable temperature it can be arranged that the hot gases are switched to the oven circuit and on to the chimney. This arrangement allows the fire to be maintained at the small cost of having the main oven somewhat heated when not actually necessary. Alternatively, the hot water may be connected to an external radiator circuit.

The boiler 18 can be made in any way which will allow it to achieve its function of bringing water into heat exchange relationship with the hot gases from the fire. It may for example be "fire-tubed", be of corrugated construction or be made by having a series of water-filled "sandwich" elements arranged to have the hot gases flow around them. As shown the water filled spaces are designated 122. It is desirable to provide small access ports to give access to all possible points where there is a flat horizontal gas-swept surface because at infrequent intervals of say once a year it would be desirable to rake out any soot deposit.

A secondary, simmering or warning oven 16 is provided adjacent to the boiler section and the gases from the boiler pass on to sweep over one side and the top of this oven to heat it. Thus the residual heat in the gases from the boiler is put to use and this oven is maintained permanently warm at virtually no extra cost.

The main oven 14 is bounded by walls 78 which are spaced apart from the main structure of the unit and by means of this the main oven is arranged to be heated from underneath, both sides and the top. In this way it will be possible to secure a rapid response to the oven thermostat and when the oven is set to a new temperature by varying the setting of its thermostat the new temperature should be achieved in about the same time as is normal with standard gas or electric ovens. Temperatures up to the highest normally used in cooking food should be easily obtainable.

The gases which have heated the oven 14 join up with gases coming up a duct 80 from the boiler 18. Both leave the appliance by a flue aperture 82 at its top right hand end. A balanced draught system for the combustion air may be incorporated, as mentioned below, though not essential. Incoming combustion air is drawn down a thin but wide duct 84 from a point close to or at the top of the main oven 14.

Because the entrance for incoming air is close to the exit 82 for flue gases, the connecting up of a balanced draft flue system, conveying both the outgoing flue gas and incoming air, facilitated and hence the use of a medium-level, through the wall chimney is greatly simplified, even on windy sites. The incoming combustion air may be prewarmed by its passage through the duct 84 because this will be heated to some extent by the adjacent warm flue gases.

The fan 62 which provides the forced draft is in a chamber 88 below the boiler 18 and the secondary oven 16. In this same chamber, accessible by means of a hinged door, there is kept a cylinder 90 of ordinary commercial bottled gas (e.g. propane or butane) for igniting the fire. Of course if mains gas was available this could be used instead of bottle gas.

The gas feeds a gas ring 91 which practically surrounds the base of the furnace vessel 24. The nozzles of gas ring 91 and hence the jets of flame from the ring when lit, are directed at the slots 48 in the furnace. There is a pilot jet for ignition of the main jets. Alternatively hot air ignition may be used as now available for ordinary fire lighting.

The furnace is under the control of a time clock and when this calls upon the fire to ignite it turns on the gas by means of a solenoid valve of conventional type whereafter the flames from the gas ring ignite the coal in the furnace 24 by virtue of the forced draught from the fan 62. At night the fan 62 stops at an interval after the drive to the auger 28 has been turned off, and during this interval the fuel in the furnace burns down somewhat. The operating sequence for the fan and the auger is governed by the time control for the furnace.

The entire appliance is heavily insulated against heat loss and various pieces of heat insulation incorporated in the appliance are indicated by reference numeral 92. The unit should be practically silent in operation. It is expected that the efficiency of the unit, in terms of low fuel consumption to achieve a given heat effect, will be very high, perhaps double that of conventional equipment.

Figure 6:
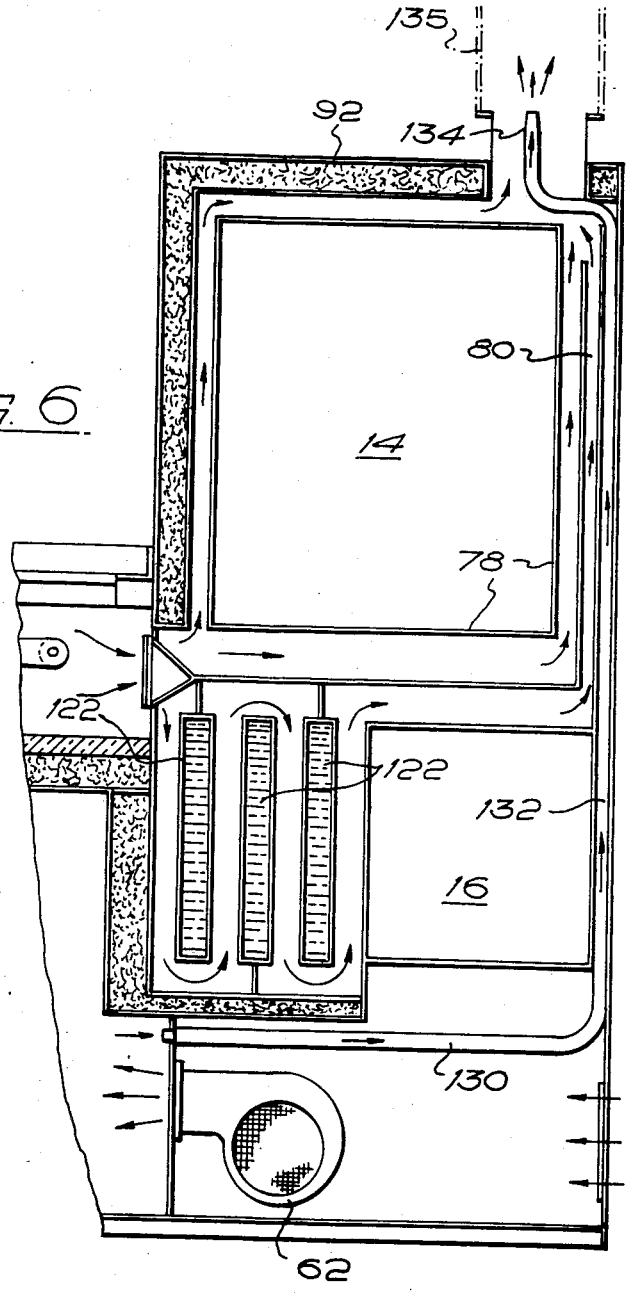
FIG. 6 is an analogous view to the right hand part of FIG. 1 showing a modification.

FIG. 6 is an analogous view to the right hand part of FIG. 1 showing a modification which may be desirable when a conventional chimney is employed.

On igniting the appliance the chimney would be cold and consequently would be giving little or no suction. With a forced draught fan feeding air for combustion into the, as yet, cold furnace there would be the possibility of smoke and fumes exuding out from the appliance instead of passing up the chimney as desired. To avoid this a bleed of the forced draft is taken through the pipe 130 (which may be perhaps provided by flexible tubing) and then up the pipe 132 leading to an outlet nozzle 134 at the outlet to the flue 135. The pipe 132 can conveniently be from 1 inch to 2 inches (25 to 50 mm) in diameter. In consequence a small proportion of the forced draft created by the blower 62 is being delivered at the nozzle 134 as a jet of clean air which is blown up the chimney is a manner somehwat analogous to the blast tube of a steam railway locomotive.

A simple valve could be provided to cut off this bleed of forced draft once the appliance was lit but it could be beneficial to leave the jet of air from the nozzle 134 at all times in order to give an accelerated draft in the chimney and thereby reduce the amount of soot being deposited.

In this modification the incoming air is now brought in through a grill 136 at a low position as shown.

A possible alternative to the forced draught arrangements shown, in which the furnace is downstream of the fan, would be an induced draught arrangement, in which the furnace is upstream of the fan, so that combustion air is sucked into the furnace.

What is claimed:

1. A domestic or small industrial heating appliance fired by solid fuel, comprising;

a rotary furnace vessel to contain a fire of the fuel and having a bottom inlet for the fuel, said vessel including a wall part above said bottom inlet with holes for the admission of combustion air provided in said wall part;

vessel drive means to drive said vessel in rotation around a generally upright axis during at least part of the time when said vessel is in use;

fuel supply means for delivering the solid fuel to said bottom inlet of said furnace vessel;

a stationary enclosure surrounding said furnace vessel and spaced from said furnace vessel to define an air space between said furnace vessel and said enclosure, said enclosure comprising a stationary water jacket surrounding at least an upper region of said furnace vessel so as to absorb heat therefrom and cool at least an upper region of said furnace vessel, said water jacket being spaced from said furnace vessel so that said air space extends between said furnace vessel and said surrounding water jacket;

means to force combustion air to flow into said air space and thereafter into said furnace vessel through said holes therein; and an air seal interposed between said water jacket and said upper region of said furnace vessel above said holes in said furnace vessel, said air seal extending outwardly from said furnace vessel, to said water jacket to define an upper boundary of said air space and constraining outflow of air from said air space to pass through said holes into the furnace vessel, said air seal comprising at least one moving flange fast with the furnace vessel and projecting therefrom and a co-operating stationary member fast with and projecting from said water jacket and lying face to face against said flange whereby both said stationary member and said moving flange are cooled by said water jacket absorbing heat therefrom, the moving flange and stationary member having apertures positioned so that the apertures in said moving flange and said stationary member periodically come into register during rotation of the furnace vessel, and then permit ash to fall through the apertures into said air space.

2. Appliance according to claim 1 comprising bearing means at the periphery of at least one said flange, said bearing means acting between said flange and said water jacket.

3. Appliance according to claim 1 comprising bearing means between the upper region of said furnace vessel and said surrounding water jacket.

4. Appliance according to claim 1 including both an oven and separate water-filled vessels in addition to said water jacket arranged to be heated by combustion gas from the fire.

5. Appliance according to claim 4 comprising a plenum chamber upstream of said oven and water-filled vessels, in which hot gases from the combustion are slowed down in order to shed entrained fly ash and dust.

6. Appliance according to claim 1 further comprising bearing means between an upper region of said furnace vessel and said water jacket;

sensing means to sense the presence of solid material at a level higher than said vessel, said sensing means including a sensing member arranged to rest upon the solid material at said level, higher than said vessel and on said axis of rotation thereof;

means automatically responsive to said sensing means to cause operation of said vessel drive means and fuel supply means, until solid material is sensed at said level and automatically responsive to said sensing means to stop operation of at least said fuel supply means when solid material is sensed at said level.

7. Appliance according to claim 1 wherein the air seal is an airlock which comprises a pair of said flanges projecting from the vessel and a pair of said stationary members each attached to said water jacket and lying face to face against a respective flange, each flange and associated stationary member having apertures positioned to periodically come into register during rotation of the furnace vessel and then permit through passage of ash, while the apertures in the other flange and stationary member are out of register with each other, thereby maintaining a continuous air seal.

8. Appliance according to claim 1 wherein said vessel drive means comprises a gear wheel extending within said air space between said furnace vessel and surrounding surrounding enclosure, said gear wheel comprising gear teeth engaging into respective said holes in the wall part of the vessel as said gear wheel and vessel rotate, whereby rotation of said gear wheel drives said vessel in rotation.

9. In a domestic or small industrial heating appliance fired by solid fuel, comprising a rotary furnace vessel to contain a fire of the fuel and having a bottom inlet for the fuel, said vessel including a wall part above said bottom inlet with air inlet holes for the admission of combustion air therethrough provided in said wall part;

vessel drive means to drive vessel in rotation around a generally upright axis during at least part of the time when said vessel is in use;

fuel supply means for delivering the solid fuel to said bottom inlet of said furnace vessel;

an enclosure surrounding at least an upper region of said furnace vessel and spaced from said furnace vessel to define an air space between said furnace vessel and said surrounding enclosure; and means to force combustion air to flow into said air space and thereafter into said furnace vessel through said holes therein;

the improvement which comprises poking means for clearing said air inlet holes, said poking means being located in said air space between said furnace vessel and said surrounding enclosure, and said vessel drive means further comprising means to urge said poking means from said air space into successive said holes and thereafter withdrawing said poking means therefrom during rotation of the furnace vessel.

10. Appliance according to claim 9 wherein said fuel supply means is connected to said vessel drive means, whereby both operate together.

11. Appliance according to claim 9 comprising a gas ring at least partially surrounding the wall part of the furnace vessel and arranged to direct a flame towards said holes, to ignite solid fuel in said vessel.

12. Appliance according to claim 9 including both an oven and separate water-filled vessels in addition to said water jacket arranged to be heated by combustion gas from the fire.

13. Appliance according to claim 9 wherein said enclosure comprises a stationary water jacket surrounding at least an upper region of said furnace vesel so as to absorb heat therefrom and cool at least an upper region of said furnace vessel, said water jacket being spaced from said furnace vessel so that said air space extends between said furnace vessel and said water jacket, the appliance further comprising seal means interposed between said water jacket and said upper region of said furnace vessel, said seal means extending outwardly from said furnace vessel to said water jacket and constraining outflow of air from said air space to pass through said holes into the furnace vessel.

14. Appliance according to claim 9 wherein said vessel drive means comprises a gear wheel extending within said air space between said furnace vessel and surrounding enclosure, said gear wheel comprising gear teeth engaging into respective said holes as said gear wheel and vessel rotate, whereby rotation of said gear wheel drives said vessel in rotation and said teeth are also said poking means.

15. Appliance according to claim 14 in which said fuel supply means comprises a fuel hopper, a laterally extending auger to deliver fuel from the hopper, said auger comprising an intake end and a delivery end, a duct enclosing said delivery end of said auger, which duct comprises an upward bend and connects to said bottom inlet of said furnace vessel so that said fuel is extruded around the bend in said duct and delivered as a vertical feed to the bottom of said vessel, and means coupling said gear wheel with the auger to rotate therewith.

16. Appliance according to claim 14 further comprising sensing means to sense the presence of solid material at a level higher than said vessel, said sensing means including a sensing member arranged to rest upon the solid material at said level said vessel and on said axis of rotation of said vessel; means automatically responsive to said sensing means to cause simultaneous operation of said vessel drive means and fuel supply means, until solid material is sensed at said level, and automatically responsive to said sensing means to stop operation of at least said fuel supply means when solid material is sensed as said level.

* * * * *